US011465817B2

(12) United States Patent
Lau et al.

(10) Patent No.: US 11,465,817 B2
(45) Date of Patent: Oct. 11, 2022

(54) PACKAGING SYSTEM WITH OPENING FOR PRODUCT ACCESS

(71) Applicant: Custom Accessories Inc., Richmond, IL (US)

(72) Inventors: Nguyen Trung Lau, South Melbourne (AU); Jason Carr, South Melbourne (AU)

(73) Assignee: Custom Accessories Inc., Richmond, IL (US)

( * ) Notice: Subject to any disclaimer, the term of this patent is extended or adjusted under 35 U.S.C. 154(b) by 390 days.

(21) Appl. No.: 16/591,932

(22) Filed: Oct. 3, 2019

(65) Prior Publication Data

US 2020/0108986 A1 Apr. 9, 2020

Related U.S. Application Data

(60) Provisional application No. 62/742,003, filed on Oct. 5, 2018.

(51) Int. Cl.
*B65D 63/10* (2006.01)
*B65D 77/22* (2006.01)
*B65D 5/42* (2006.01)

(52) U.S. Cl.
CPC ..... *B65D 63/10* (2013.01); *B65D 5/4204* (2013.01); *B65D 77/22* (2013.01); *B65D 2563/101* (2013.01)

(58) Field of Classification Search
CPC ..... B65D 5/42; B65D 5/4204; B65D 63/10; B65D 71/00; B65D 77/22; B65D 85/00; B65D 2563/101
See application file for complete search history.

(56) References Cited

U.S. PATENT DOCUMENTS

| | | | | | |
|---|---|---|---|---|---|
| 1,991,306 | A * | 2/1935 | Woolsey | A45C 13/02 | 132/312 |
| 5,386,905 | A * | 2/1995 | Porter | A01F 25/13 | 206/83.5 |
| 5,511,655 | A * | 4/1996 | Porter | A01F 25/13 | 150/154 |
| 5,720,382 | A * | 2/1998 | Porter | A01F 25/13 | 150/154 |
| 5,725,089 | A * | 3/1998 | Ravet | B66C 1/18 | 206/442 |
| 8,186,400 | B2 * | 5/2012 | Lummis | B65D 85/07 | 150/154 |
| 8,439,199 | B2 * | 5/2013 | Ravary | G09F 3/14 | 206/494 |
| 8,936,155 | B2 * | 1/2015 | Ravary | G09F 3/14 | 206/494 |
| 2017/0079426 | A1 * | 3/2017 | Davis | B65D 9/12 | |

* cited by examiner

*Primary Examiner* — Bryon P Gehman
(74) *Attorney, Agent, or Firm* — Leydig, Voit & Mayer, Ltd.

(57) ABSTRACT

A packaging system and method for an article includes a strap having an elongate shape and being made from a flexible material, and container having an opening. The container defines a space. In a packaged configuration, first and second ends of the strap are connected to one another to form a loop, the article is folded in a bundle and disposed within the space in the container, and the loop extends through a portion of the bundle and two slits formed in the container to secure the article into the container.

17 Claims, 11 Drawing Sheets

PACKAGING SYSTEM WITH OPENING FOR PRODUCT ACCESS

CROSS-REFERENCE TO RELATED APPLICATIONS

The present application claims the benefit of U.S. Provisional Patent Application No. 62/742,003, filed on Oct. 5, 2018, and titled "Packaging System with Opening for Product Access," the disclosure of which is incorporated herein in its entirety by this reference.

FIELD OF THE DISCLOSURE

The present disclosure relates to product packaging and, more particularly, to product packaging having an opening for product access.

BACKGROUND

Containers and packages are used to transport and display products in retail environments. For some types of products, access to the product while within its packaging is important to permit potential purchasers to touch the product. This is often especially important for products made out of a fabric material. For example, a customer may want to feel the softness of the product while making a purchasing decision.

Containers that fully enclose the products either prevent customers from touching the products or require the customers to open the packaging. In both instances, a customer may forego further consideration of the product. Further, opening the packaging may damage the packaging and reduce the saleability of the product. Some containers partially enclose the products but still may suffer from customers damaging the packaging in an attempt to separate the product from the packaging. This again may reduce the saleability of the product.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

BRIEF SUMMARY OF THE DISCLOSURE

In one aspect, the disclosure describes a packaging system for an article. The packaging system includes a strap having an elongate shape and being made from a flexible material. The strap has a first end and a second end. The container defines a space therein and includes at least a front wall, a rear wall, two sidewalls and a bottom wall. Two flaps are connected, one each, to the two sidewalls along a respective fold line, each fold line including a slit. In a packaged configuration, the first and second ends of the strap are connected to one another to form a loop. The article is adapted to be folded in a bundle and disposed within the space in the container, and the loop extends through a portion of the bundle and the two slits in respective fold lines to secure the article into the container.

In another aspect, the disclosure describes a method for packaging an article in a container. The method includes providing a strap having an elongate shape, the strap having first and second ends that connectable to one another such that, when connected, the strap forms a closed loop; providing a container that defines a space and has an end that is at least partially open, the space being defined between a front wall, a rear wall, two sidewalls and a bottom wall; wherein the container further includes two flaps connected, one each, to the two sidewalls along a respective fold line, each fold line including a slit; folding the article into a bundle, the bundle surrounding at least a portion of the strap such that the first and second ends of the strap extend on either side of the bundle; placing the bundle into the space in the container; threading each of the first and second end of the strap through a respective slit; and connecting the first and second ends to one another to form the loop.

DETAILED DESCRIPTION

Figure 1:
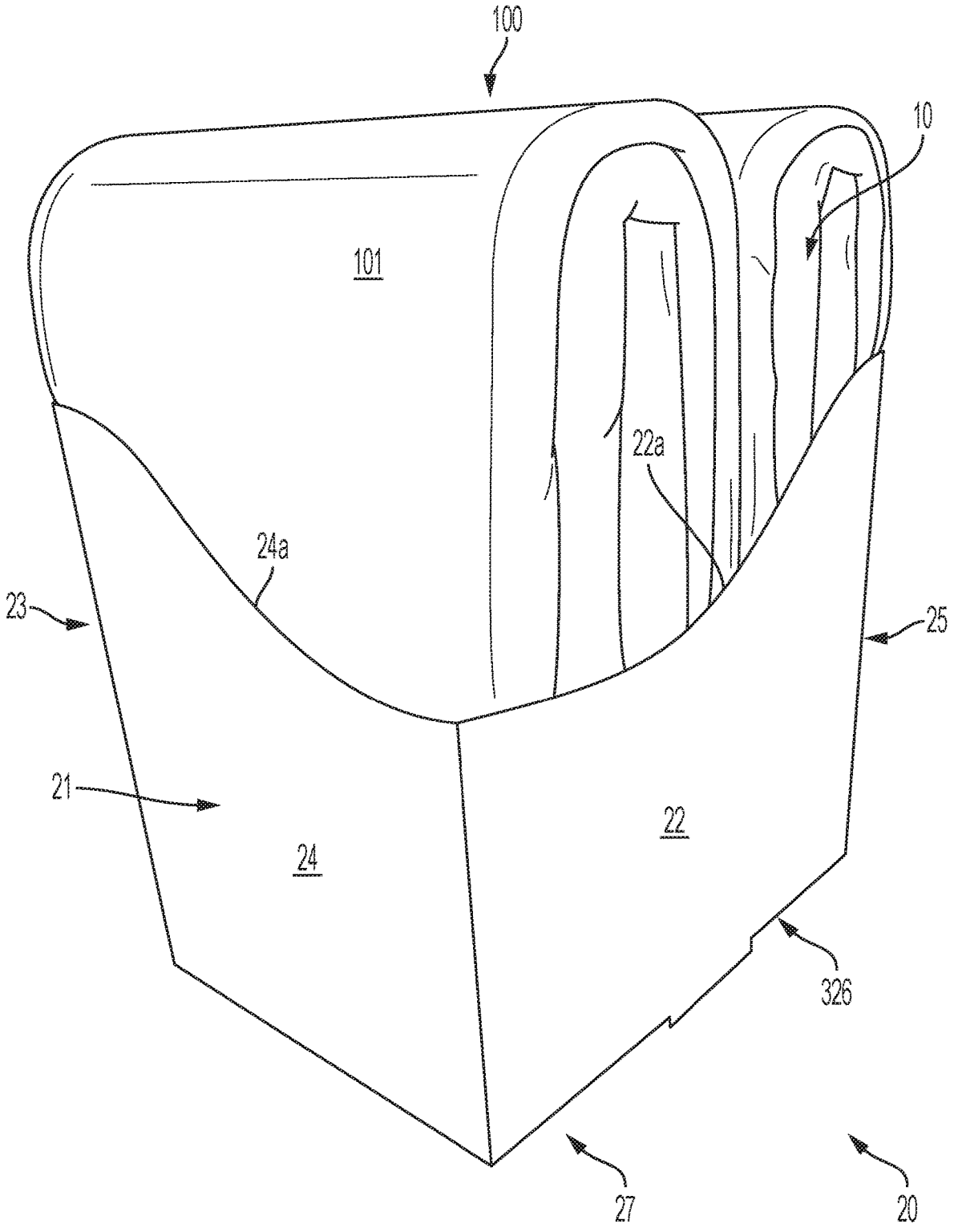
FIG. 1 is an outline view of a first embodiment of a packaging system containing a product secured thereto in accordance with the disclosure.
Figure 3:
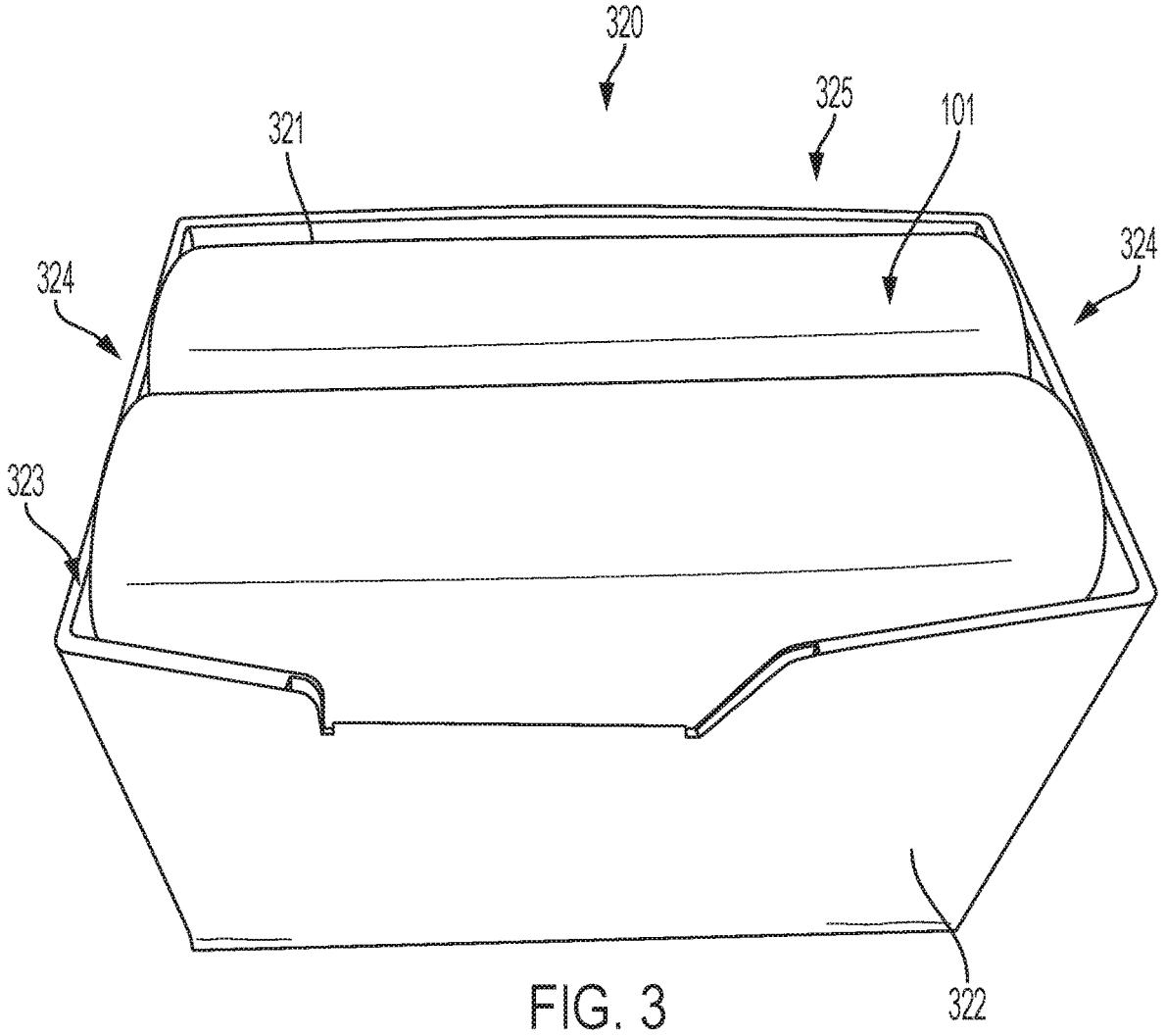
FIG. 3 is an outline view of a third embodiment of a packaging system containing a product secured thereto in accordance with the disclosure.

Referring to FIG. 1, a pair of products or articles 101 in the form of seat covers 101 are secured within packaging systems 20. The packaging system 20 includes a product container or package 21 together with a product retention system, generally in the form of an anchor strap 341 (FIG. 3). In one exemplary embodiment, the products 101 are made from a compliant material such as fabric, which a potential purchaser may wish to touch and feel before making a purchase decision. For this reason, and to provide tactile access while the product is presented for sale to a potential purchaser, for example, by being displayed on a store shelf, the container includes a large opening that permits the potential buyer to touch and feel the product using their entire hand. The large exposed area of the product is advantageous over previously proposed designs in that it permits a person to run their hand over a portion of the product in a caressing motion without disturbing the packaging and without breaking or otherwise tearing the packaging, and also without opening the packaging, as the case may be.

Figure 2:
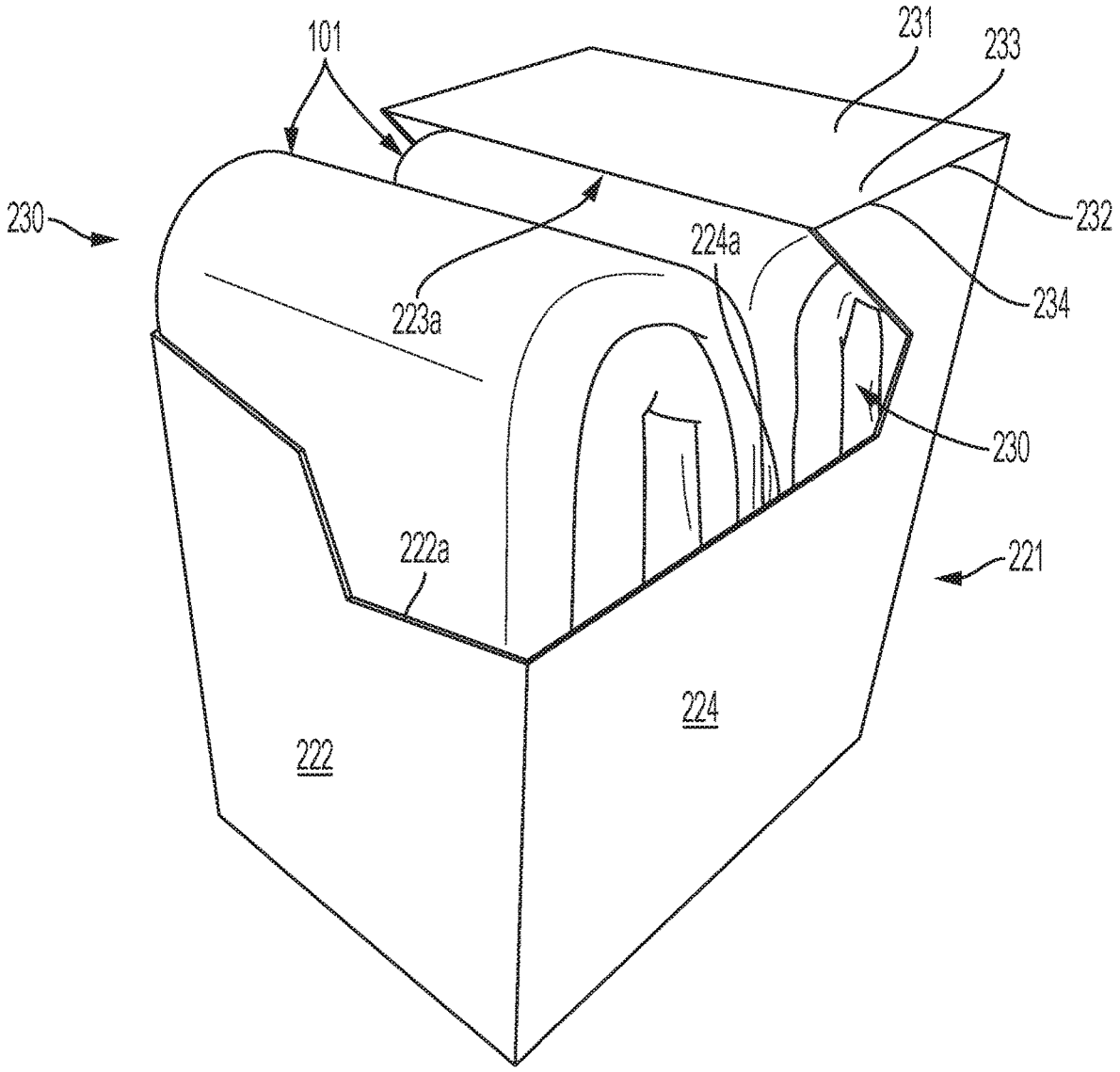
FIG. 2 is an outline view of a second embodiment of a packaging system containing a product secured thereto in accordance with the disclosure.

The container 21 represents a first embodiment for a container, with alternative embodiments shown in FIGS. 2 and 3. All these embodiments have in common an opening or open end formed in the container. For example, in the embodiment shown in FIG. 1, the container 21 has a generally rectangular cuboid- or box-shape with an open upper end 10. More specifically, the container 21 has a front wall 22, a rear wall (not shown) and spaced apart side walls 24, 25 that interconnect the front wall and the rear wall. A space is defined between these walls to accommodate the product. The container 21 further includes a bottom or lower wall 326 (FIG. 7), extending between each of the front wall, rear wall, and the side walls to close the lower opening or end 27 of the container.

The upper end 10 of the container 21 is open while the lower end 27 is closed by the lower wall 326. The container 21 can have any configuration with an open, or partially open, end or wall to permit access to the product 101 within the container. In the embodiment illustrated in FIG. 1, the front wall 22 and one of the side walls 24 are depicted with portions 22*a*, 24*a*, respectively of their upper edges that are shorter than the rear wall 23 and the other side wall 25. In reference to FIG. 7, the lower wall 326 is interconnected to the rear wall 23 along a fold line 30 and may include one, two or more locking tabs 332. Inner side flaps 333 extend from each of the side walls 24, 25 along fold lines 334 and a front flap 336 extends from front wall 22 along a fold line 315. Slots 335 are provided adjacent or along the fold lines 334 and slots 337 are provided along fold line 315 to accept tabs 350 having their own slots 352 to create an interlocking engagement. The container 21 may be formed of any desired material such as, for example, cardboard, paper board, plastic and the like.

The shape of the opening in the container permits a person to touch, squeeze and feel the surface and resilience of the product without disturbing the way the product is packaged or the container, and also without removing the product from the container. Previously proposed solutions include making a hole, for example, of a few inches, into a sidewall of an otherwise closed box to allow touching of the box's contents. The present disclosure proposes exposing an entire side, because mere touching of the product with a few fingers is not satisfactory for someone to gain a full appreciation of the product's attributes.

Referring now to the embodiment shown in FIG. 2, the container 221 has a front wall 222, a rear wall (not visible), two sidewalls 224, and a partial upper wall or surface 231. The front wall 222 and sidewalls 224 include cutout portions 230, through which upper portions of the displayed products 101 are exposed. The cutout portions 230 are defined between linear upper edges 222*a*, 224*a*, respectively, and an inner edge 223*a*. The upper and inner edges 222*a*, 223*a* and 224*a* may be defined by linear segments that extend along the container walls at various angles to create any appropriate shape for the opening or cutout portion 230.

As shown, the container 221 includes a partial upper wall or surface 231 that extends along a portion of the sidewalls 224 and from the rear wall (not shown) to further enclose the products 101 and provide additional support or rigidity to the container, for example, when stacking multiple containers onto one another. The partial upper wall 231 may be formed as an extension of the rear wall that is folded along the intersection between the rear wall and the partial upper wall and then secured to the side walls 224 at the intersection 232 between the side walls 224 and the partial upper wall 231 with tabs 233 on the side walls that extend into openings 234 in the partial upper wall. Other manners of forming the partial upper wall are contemplated.

Referring now to the embodiment shown in FIG. 3, an alternative embodiment for a packaging system 320 is depicted. The packaging system 320 can be similar to those previously described in that a container 321 has an open top to expose portions of the product 101. In this embodiment, the top edges 323 of the front wall 322, the two sidewalls 324, and the rear wall 325 are coplanar to create an orthogonal space into which the product 101 is placed. In this way, a generally flat top edge is presented, which permits stacking of the boxes such that each box placed on top of another may rest along the top edges 323 of the container 321.

Figure 4A:
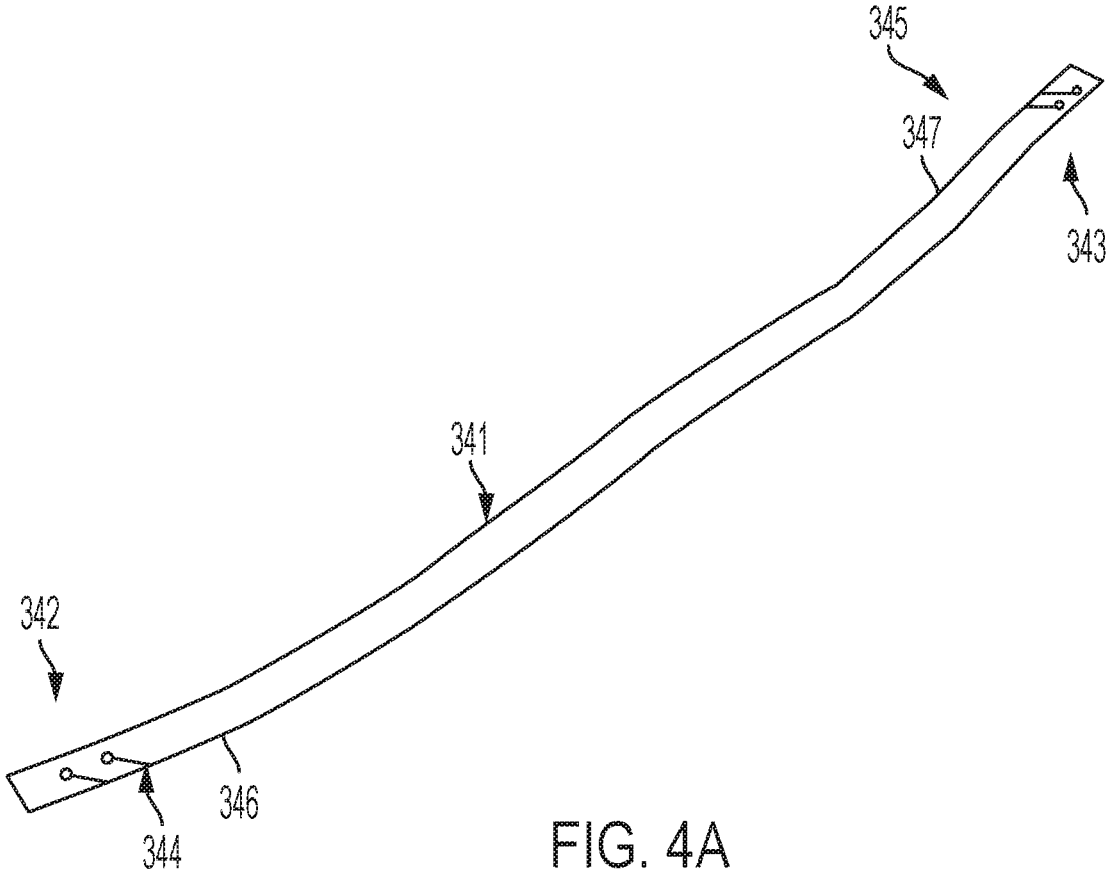
FIG. 4A is an overall view of an anchor strap in accordance with the disclosure.

A bundling strap 341 for use with any of the containers described above is shown in FIGS. 4A, 4B and 4C. The bundling strap performs two functions. The first function is to bundle the product such that the product maintains its folded configuration while packaged within the container. The second function is to retain the product within the container but in a flexible way that allows the product to be handled while still engaged within the container. The bundling strap does not wrap entirely around the product 101 but rather is configured such that its ends are connectable to one another so that the strap can engage a portion of the product 101 and also a portion of the container in which the product is placed, in this way securing the product to the container without the ability of the product being removed from the container either by accident, for example, during shipment, or by a person handling the product and container. In the event the product is removed from the container, the strap will be broken to evidence that the product or packaging have been mishandled or at least opened.

Figure 4B:
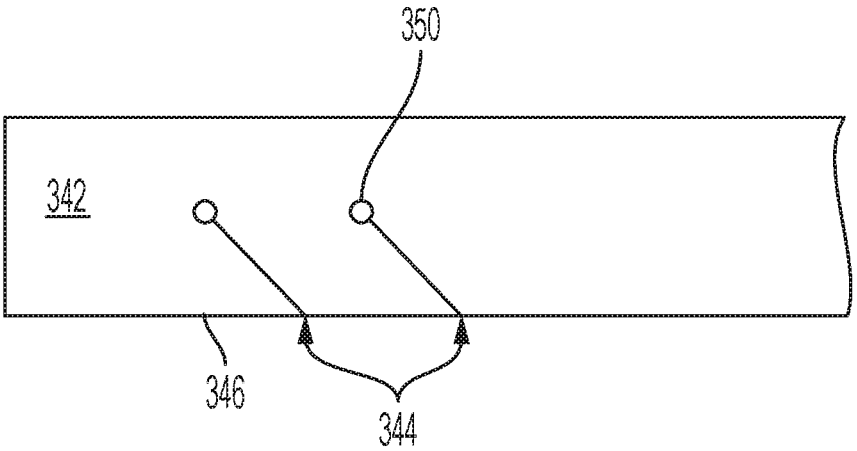
FIGS. 4B and 4C are enlarged detail views of end portions of the anchor strap shown in FIG. 4A.
Figure 4C:
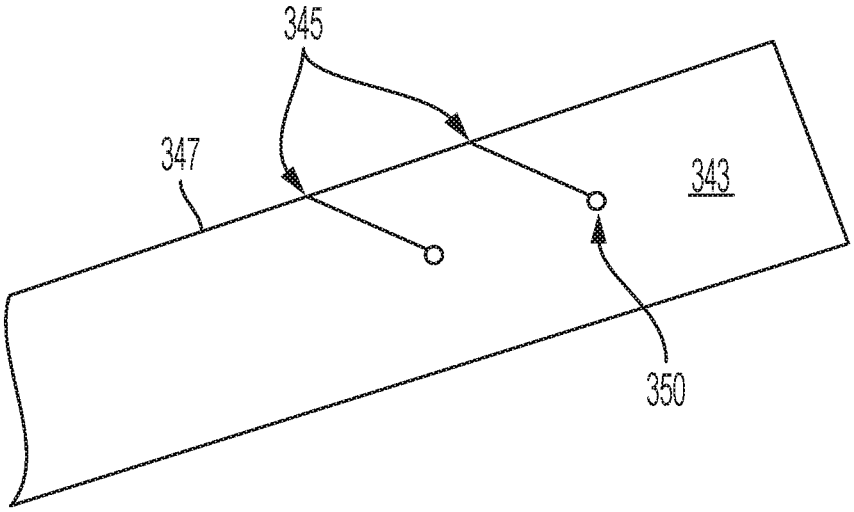
Figure 5:
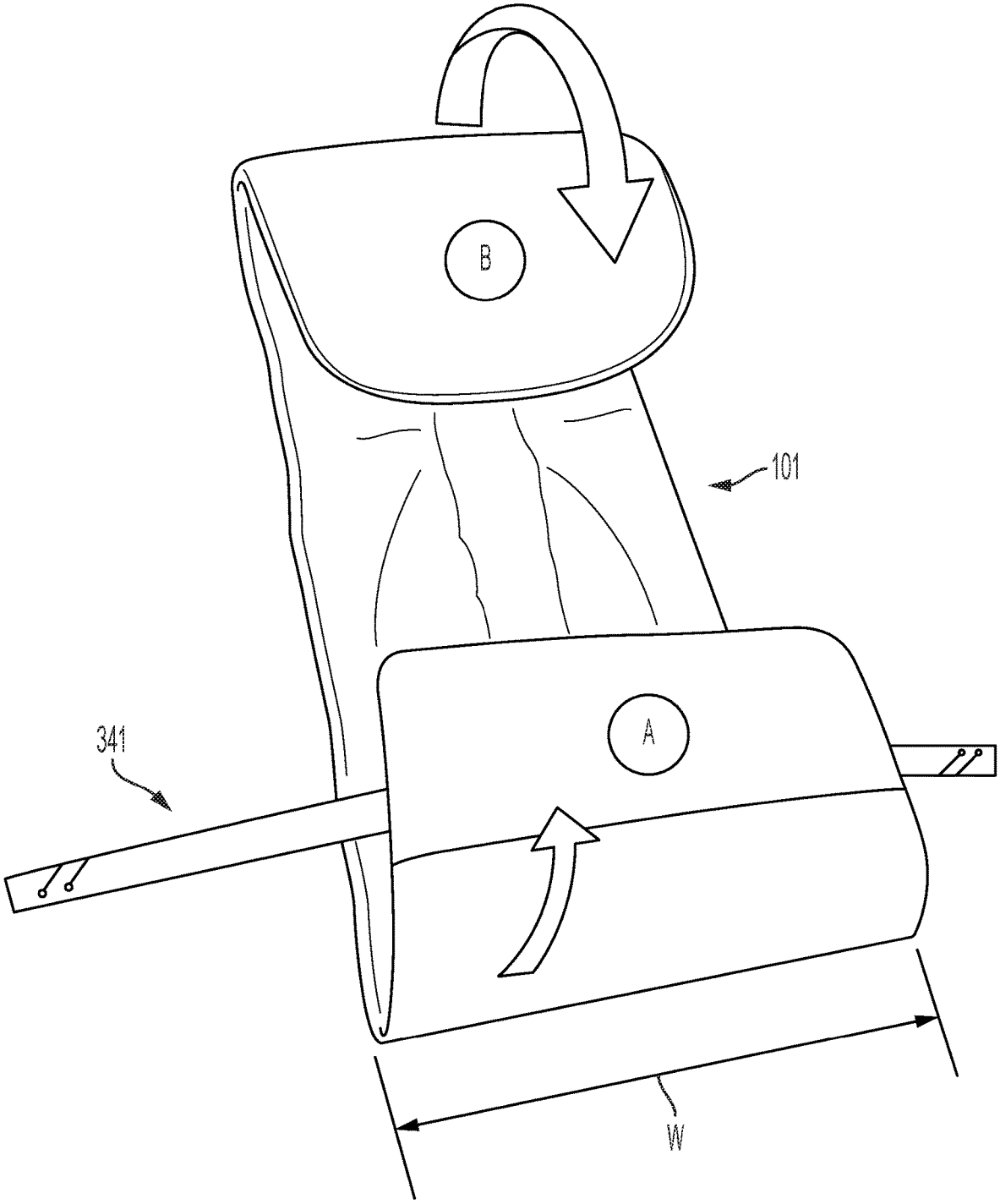
FIGS. 5 and 6 are views of a partially assembled anchor strap around a portion of a product in accordance with the disclosure.

More specifically, the bundling strap 341 includes a first end 342, shown enlarged in FIG. 4B, and a second opposite end 343, shown enlarged in FIG. 4C. A body of the strap is made by a thin strip material, such as PET, PVC or the like, that is flexible and allows bending to form the strap into a loop. Each of the first and second ends 342, 343 includes a plurality of angled locking slits 344, 345 that project inwardly from a side edge of the bundling strap. The slits 344 of the first end 342 extend from a first edge 346 of the bundling strap and the slits 345 of the second end 343 extend from the second edge 347 of the bundling strap. Each of the slits 344 and 345 terminates at a circular opening 347 that avoids tearing of the strap 341 at the inner end of each strip due to stress concentration and provides space in which material engagement can occur when the locking slits 344 and 345 are engaged to form a hoop from the strap 341. Upon forming the bundling strap 341 into a closed or generally circular structure, the slits 344, 345 from the first and second ends 342, 343 slide into each other to lock the ends together. To evidence tampering, upon pulling onto the hoop made from the strap 341, one of the ends will tear at the slit, beginning at the opening 350, so that the same strap 341 cannot be reinstalled.

Use of interlocking slits at the ends of the bundling strap 341 permit the selective assembly and disassembly of the strap into a loop configuration, but it should be appreciated that other methods of attaching the strip ends to form a loop can be used. For example, adhesive can be used to connect the ends of the strip to each other when a single-use or permanent installation of the strap is desired. Similarly, other features such as interlocking notches, buttons or snaps, coated metal wire twists, zip ties and other devices instead of slits can also be used.

Figure 6:
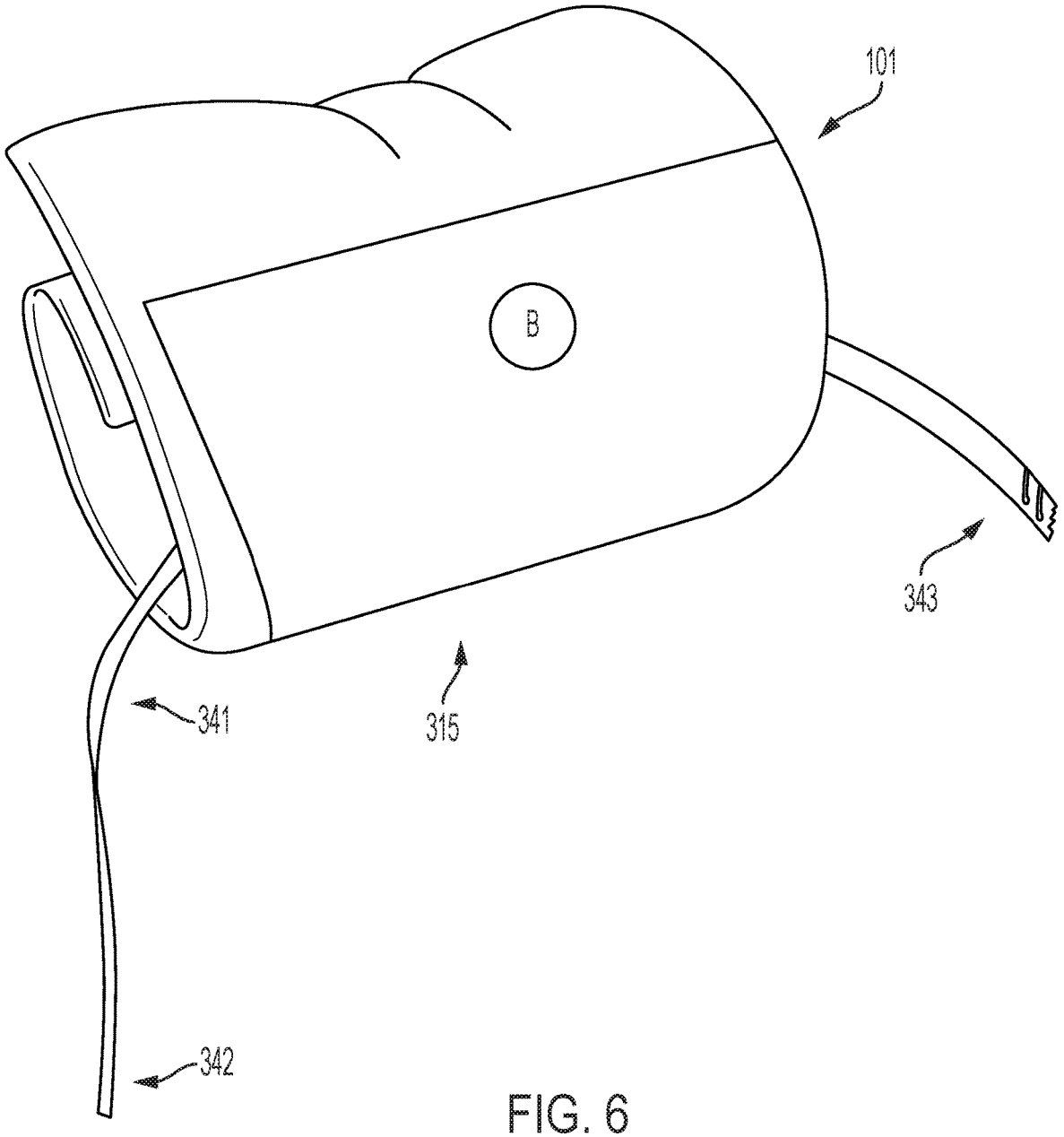

An exemplary process for manufacturing an assembly of the packaging system 100 using the strap 341 to secure a product 101 such as a seat cushion is shown in FIGS. 5-10. More specifically, in a first step, the product 101 is folded such that its outer edges are turned in to form a long strip having a width, W, that matches a width of the container in which the product will be placed. One end, A, of the strip is folded over a generally central portion of the strap 341, and then a second end B is wrapped around the end A to form a bundle around the central portion of the strap 341, as shown in FIG. 6. In this condition, the ends of the strap 341 extend past both sides of the bundled product 101. One strap 341 can be used for each article of the product 101 that will be stored in the container. Alternatively, one strap can be used to bundle two or more articles of the product 101, depending on the desired configuration and folding position of the articles.

Figure 7:
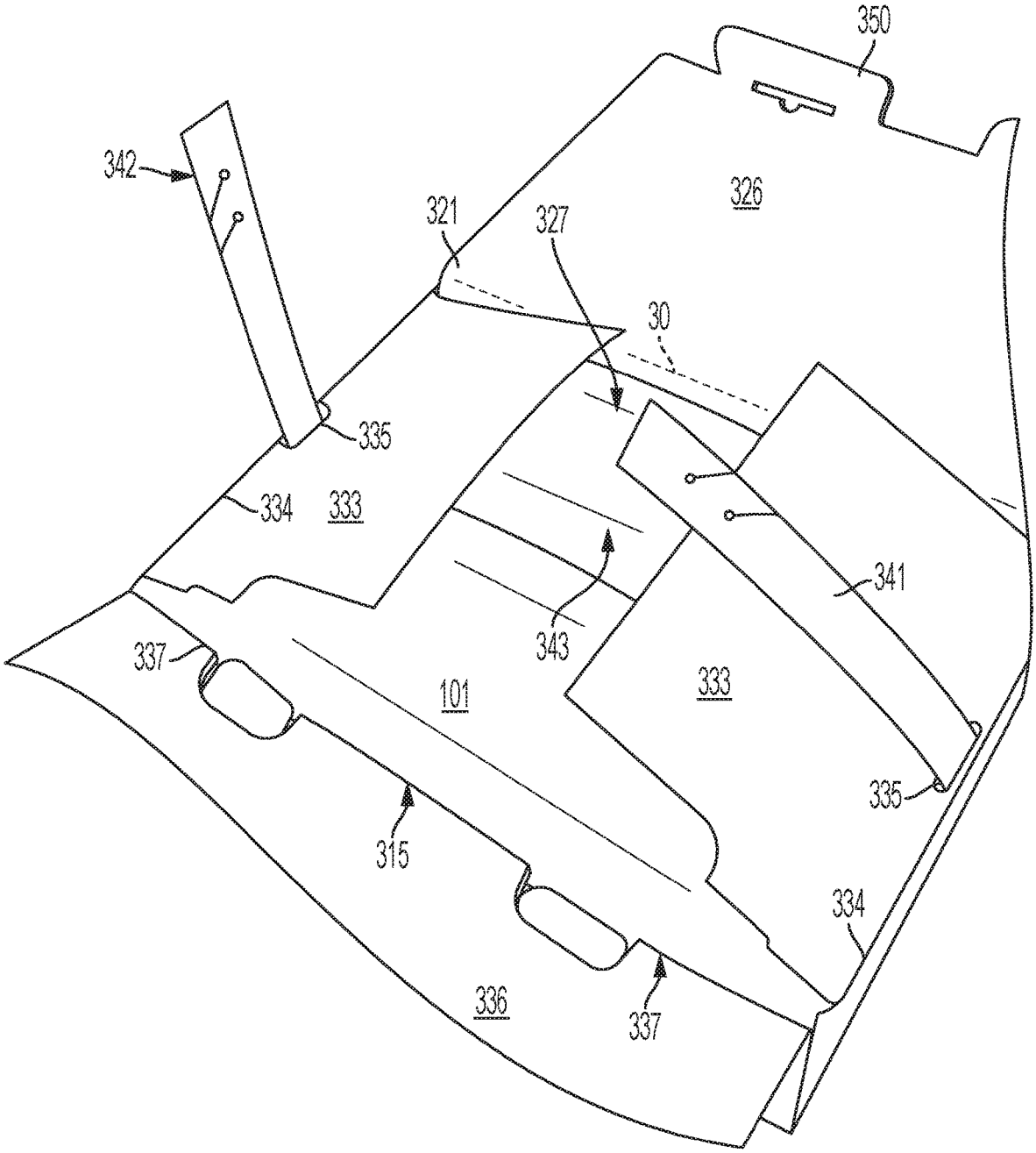
FIGS. 7-9 are bottom views of a product inserted into a container as shown in FIG. 1, 2 or 3, at various stages during an assembly process in accordance with the disclosure.

The product bundle containing the strap is then inserted into the container 321 as depicted in FIG. 7. The product bundle may be inserted through the top opening, or through the bottom of an opened container, before the bottom wall is positioned. When the bundle is inserted into the container, the first and second ends 342, 342 of the bundling strap 341 are inserted through slits or openings 335 formed along a fold line 334 disposed between the sidewalls 324 and inner side flaps 333 of the container.

Figure 8:
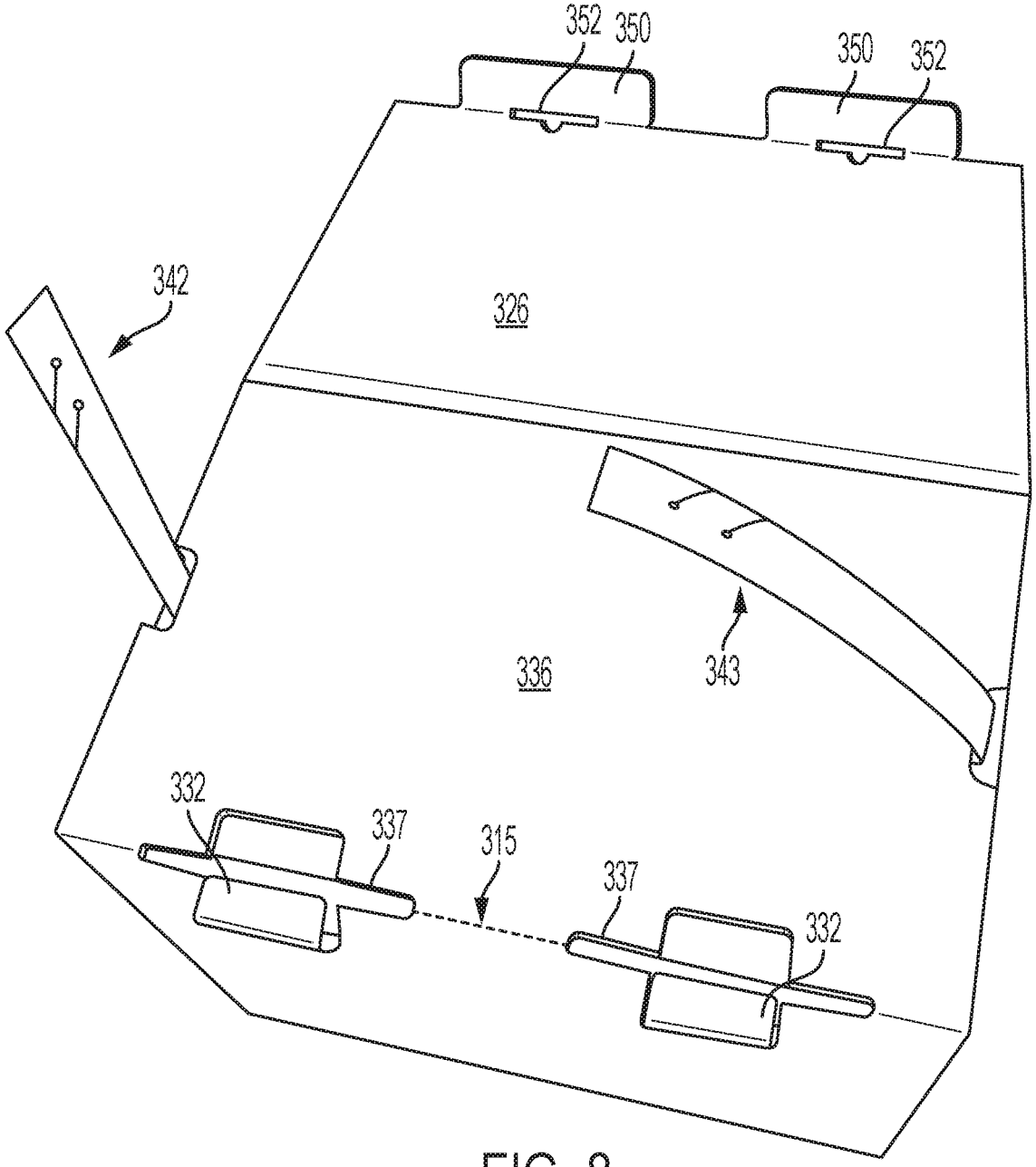
Figure 9:
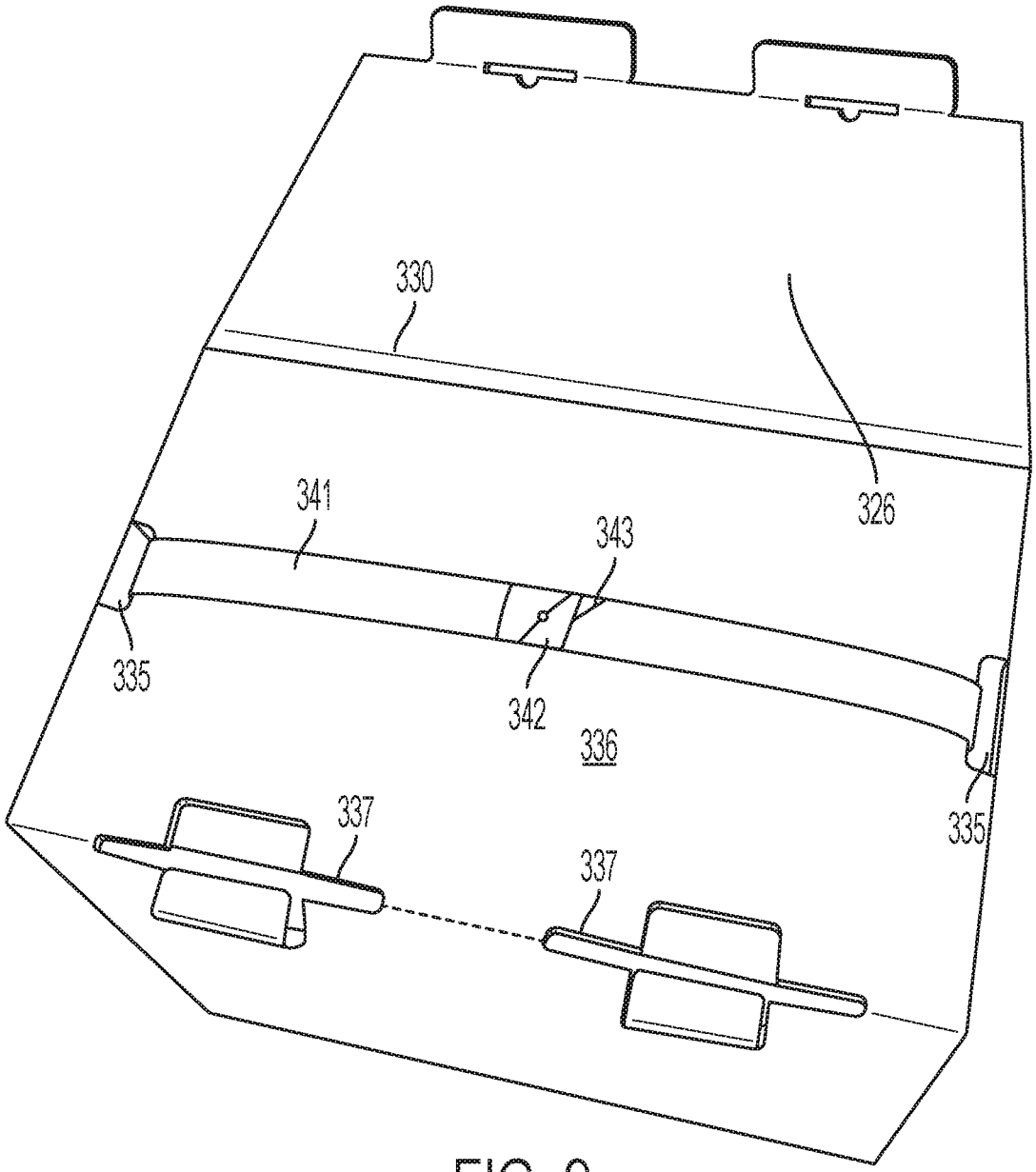
Figure 10:
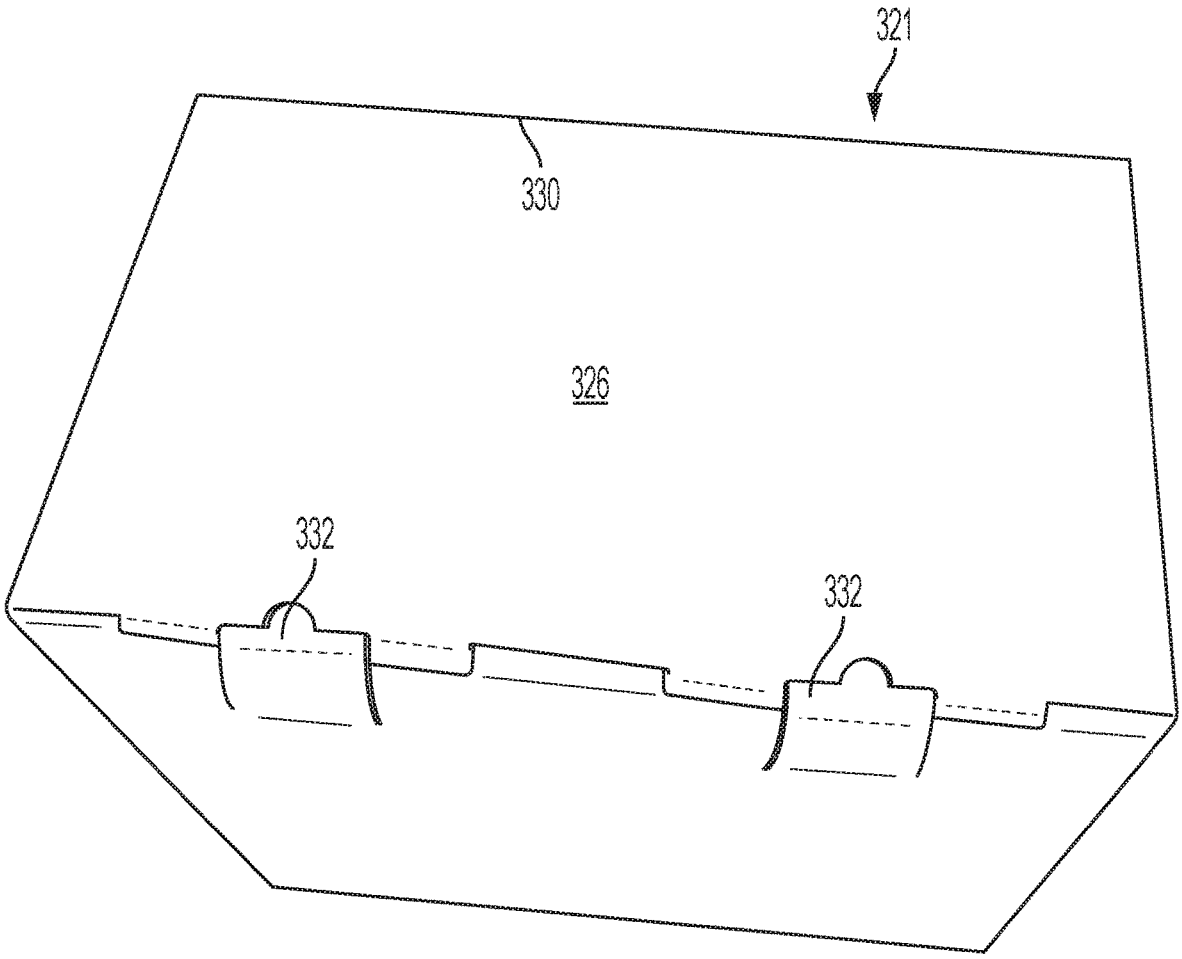
FIG. 10 is a bottom view of a completed assembly of a product secured into a container in accordance with the disclosure.

The front flap 336 of the of the container 321 is extended so that, when closed, the front flap 336 extends across and closes the entire lower opening 327 of the container 321. In FIG. 8, the front flap 336 is shown closed and extends across the lower opening 327. In FIG. 9, the first and second ends 342, 343 of the bundling strap 341 are folded or positioned along the outer surface of the front flap 336 so that one of the transverse slits 344 of the first end is aligned with one of the transverse slits 344 of the second end 343 of the bundling strap 341. The aligned transverse slit 344, 345 are then slid into each other to secure the two ends 342, 343 of the bundling strap together. As depicted in FIG. 10, the lower wall 326 is then folded along fold line 330 to close the lower opening of the container 321. The front locking tabs 332 on the lower wall 326 are inserted into the slots 337 at the fold line 338 to secure the lower wall to the front wall 322. The lower wall 326 thus covers the joint between the two ends 342 and 343 of the strap.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context. Still further, the advantages described herein may not be applicable to all embodiments encompassed by the claims.

The invention claimed is:

1. A packaging system for an article, comprising:

a strap having an elongate shape, the strap being made from a flexible material and having a first end and a second end;

a container defining a space therein, the container including at least a front wall, a rear wall, two sidewalls and a bottom wall;

two flaps connected, one each, to the two sidewalls along a respective fold line, each respective fold line including an opening;

wherein, in a packaged configuration, the first and second ends of the strap are connected to one another to form a loop, wherein the article is folded in a bundle and disposed within the space in the container; and wherein the loop extends through a portion of the bundle and the two openings in respective fold lines to secure the article into the container.

2. The packaging system of claim 1, wherein the strap is made from a thin, strip material.

3. The packaging system of claim 1, wherein each of the first end and the second end of the strap includes a slit, such that the slits in the first and second ends are engaged to connect the first and second ends of the strap to form the loop.

4. The packaging system of claim 3, wherein each slit is angled relative to a longitudinal dimension of the strap, each slit projecting inwardly from a side edge of the strap.

5. The packaging system of claim 4, wherein each of the first and second ends includes a plurality of slits extending in parallel to one another.

6. The packaging system of claim 5, wherein each of the plurality of slits in the first and second ends of the strip terminates at a respective circular opening.

7. The packaging system of claim 1, wherein, in the packaged configuration, the loop extends between the two flaps and the bottom wall.

8. The packaging system of claim 1, wherein a connection between the first and second ends of the strap is both releasable and breakable.

9. The packaging system of claim 1, wherein the container further includes a partial top wall.

10. The packaging system of claim 1, wherein the container is made of cardboard and the strap is made of plastic.

11. A method for packaging an article in a container, comprising:

providing a strap having an elongate shape, the strap having first and second ends that are connectable to one another such that, when connected, the strap forms a loop;

providing the container that defines a space and has an end that is at least partially open, the space being defined between a front wall, a rear wall, two sidewalls and a bottom wall;

wherein the container further includes two flaps connected, one each, to the two sidewalls along a respective fold line, each fold line including an opening;

folding the article into a bundle, the bundle surrounding at least a portion of the strap such that the first and second ends of the strap extend on either side of the bundle;

placing the bundle into the space in the container;

threading each of the first and second ends of the strap through a respective opening; and connecting the first and second ends to one another to form the loop.

12. The method of claim 11, further comprising folding the two flaps towards the space, and folding the bottom wall to cover the loop such that the loop extends between the two flaps and the bottom wall.

13. The method of claim 11, wherein each of the first and second ends of the strap includes a slit extending at least half way through a width of the strap, and wherein connecting the first and second ends to one another includes engaging the slit in the first end with the slit in the second end slits with one another.

14. The method of claim 11, wherein the strap is made from a thin, strip material.

15. The method of claim 11, wherein the strap is configured to break when the bundle is pulled from the space in the container.

16. The method of claim 11, further comprising partially enclosing the space on a top side by providing a partial top wall on the container.

17. The method of claim 11, wherein the container is made of cardboard and the strap is made of plastic.

* * * * *